US005242211A

United States Patent [19]

Grad et al.

[11] Patent Number: 5,242,211

[45] Date of Patent: Sep. 7, 1993

[54] STACKABLE SWIVEL CHAIR

[76] Inventors: Jan Grad; Sylvester Klus, both of Kottbusserdamm 70, 1000 Berlin 61; Peter W. Karg, Beatestr. 41, 1000 Berlin 21; Michael Hertig, Hohenzollerndamm 105, 1000 Berlin 30, all of Fed. Rep. of Germany

[21] Appl. No.: 782,813

[22] Filed: Oct. 25, 1991

[30] Foreign Application Priority Data

Oct. 25, 1990 [DE] Fed. Rep. of Germany ..... 4034297

[51] Int. Cl.[5] ..... A47C 3/04

[52] U.S. Cl. ..... 297/239; 297/344.26

[58] Field of Search ..... 297/349, 239; 108/91

[56] References Cited

U.S. PATENT DOCUMENTS

| | | | |
|---|---|---|---|
| 1,617,805 | 2/1927 | Hansen | 297/349 |
| 2,967,565 | 1/1961 | Schultz | 297/239 |
| 3,100,459 | 8/1963 | Liss et al. | 297/239 |
| 3,459,449 | 8/1969 | Klausen | 297/239 |
| 3,774,960 | 11/1973 | Blodee | 297/239 |
| 4,884,842 | 12/1989 | Finkelstein | 297/349 X |

FOREIGN PATENT DOCUMENTS

| | | | |
|---|---|---|---|
| 771457 | 11/1967 | Canada | 297/349 |
| 728006 | 11/1942 | Fed. Rep. of Germany . | |
| 812705 | 9/1951 | Fed. Rep. of Germany . | |
| 1383394 | 11/1964 | France . | |
| 2301158 | 12/1974 | France | 297/239 |
| 648312 | 10/1962 | Italy | 297/349 |

*Primary Examiner*—James R. Brittain

[57] ABSTRACT

A swivel chair has of an upper frame comprising a seat and, optionally, comprising a back rest, and an underframe and a supporting column. The supporting column extends between the upper frame and the underframe. The upper frame is pivotally mounted at the upper end of the supporting column by a bracket and the supporting column is mounted to the underframe. The supporting column is linked with the underframe outside the vertical projection of the upper frame and the seat, at its periphery, is provided with a recess, the width of which corresponds substantially to the outer diameter of the supporting column. The back rest, if present, is provided with a back rest cleavage corresponding to the recess.

13 Claims, 4 Drawing Sheets

STACKABLE SWIVEL CHAIR

BACKGROUND

1. Field of the Invention

The invention relates to a swivel chair consisting of an upper frame comprising a seat and, optionally, a back rest, consisting of an underframe and a supporting column proceeding between the upper frame and the underframe, the upper frame being pivotally mounted at the upper end of the supporting column by means of a bracket and the supporting column being mounted at the underframe.

2. Prior Art

Such swivel chairs are known for example from DE-PS 812 705, where a chair is shown, the seat of which is pivotally disposed on the underframe. This chair, although pivotal, is not stackable because the underframe does not fit over the seat and the back rest. A chair is known from DE-PS 728 006 in which case only its seat is pivotally mounted on the underframe, which cannot, however, be stacked. It is thus a disadvantage that, when not used or when stored, they require a relatively large individual storage space.

From FR-PS 13 83 394 a chair is known, consisting of a supporting frame, comprising a seat and a back rest. The supporting frame consists of a single, central tube, which is linked with an angularly spaced foot part. The underframe supporting the seat is in this context bent inwardly from the vertical projection so that the upper part of this chair can be springy. This chair is, however, not pivotal and can also not be stacked due to its single tube construction. Finally, a chair is known from U.S. Pat. No. 37 74 960 in which case a springy underframe supports a seat and a back rest, linked to the seat. The seat and the back rest are in this context longitudinally spaced. Such a chair, although stackable, is, however, not pivotal so that after a certain period of use fatigue and loss of concentration of the person using it, occurs.

It is the object of this invention to so design a swivel chair of the type described in the opening paragraph which is stackable.

SUMMARY OF THE INVENTION

In accordance with this invention, chairs of the kind described are provided with a supporting column which is linked with the underframe outside the vertical projection of the upper frame, the seat is provided with a recess at its periphery, the width of which corresponds substantially to the outer diameter of the supporting column and the back rest, if present, is provided with a back rest cleavage corresponding to the recess. By these measures a swivel chair is provided where the supporting column, hindering stackability, is disposed outside the seat region so that the chairs can be stacked one above the other.

Further advantageous features are described in the subsidiary claims. However, it should be understood that the detailed description and specific examples, while indicating preferred embodiments of the invention, are given by way of illustration only, since various invention will become apparent to those skilled in the art from this detailed description.

DESCRIPTION OF THE PREFERRED EMBODIMENTS

Figure 1:
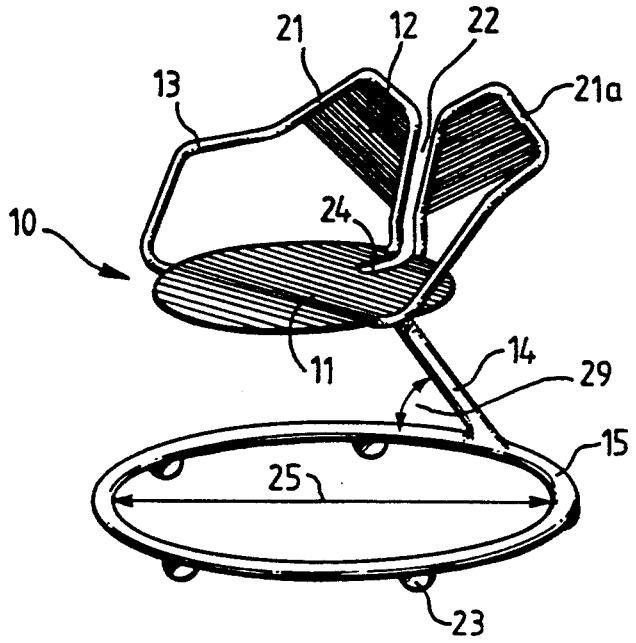
FIG 1—the isometric representation of a stackable swivel chair comprising a supporting column obliquely directed from the vertical projection of the upper frame and comprising an underframe disposed concentrically to the seat.

The swivel chair illustrated in FIG. 1 consists essentially of an upper frame 10 comprising a seat 11 associated with a back rest 12 and arm rests 13. The seat 11 is supported by a supporting column 14 which is connected to an underframe 15. The supporting column 14 proceeds at an angle of tilt 29 obliquely from the vertical projection 27 of the upper frame 10. The upper frame 10 consisting of the seat 11, the arm rests 13 and the back rest 12.

Figure 2:
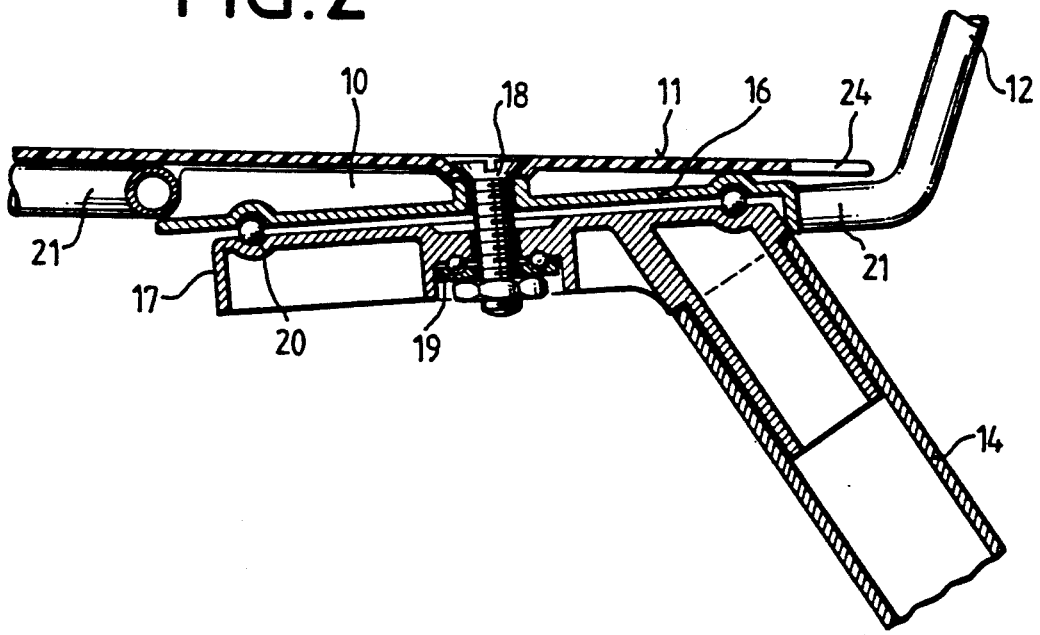
FIG. 2—the section through the upper frame in the region of the pivotal mounting of the seat on a bracket supported by the supporting column.

As shown in FIG. 2, the supporting column 14 is connected in one piece to a bracket 17 at its upper free end. The bracket 17 is circular and a vertical pivot 18 is located in the center thereof. The pivot 18 is connected with the seat 11. On the side facing away from the seat 11 the pivot 18 is provided with a pivot bearing 19 designed as an axial bearing.

The seat 11 rests on a swivel fitting 16 which is connected with a back rest frame 21 and 21*a*. The swivel fitting 16 is pivotally mounted on the bracket 17 by means of a seat swivel bearing 20. As is further shown in FIG. 1, the back rest 12 is supported by a back rest frame 21 and 21*a* divided into two parts. The back rest frame 21, 21*a* consists of a tube which, as shown in FIG. 2, serves at the same time as a support for the swivel fitting 16 and proceeds underneath arm rests 13 under the seat 11 and is connected to the seat and the swivel fitting 16.

Figure 3:
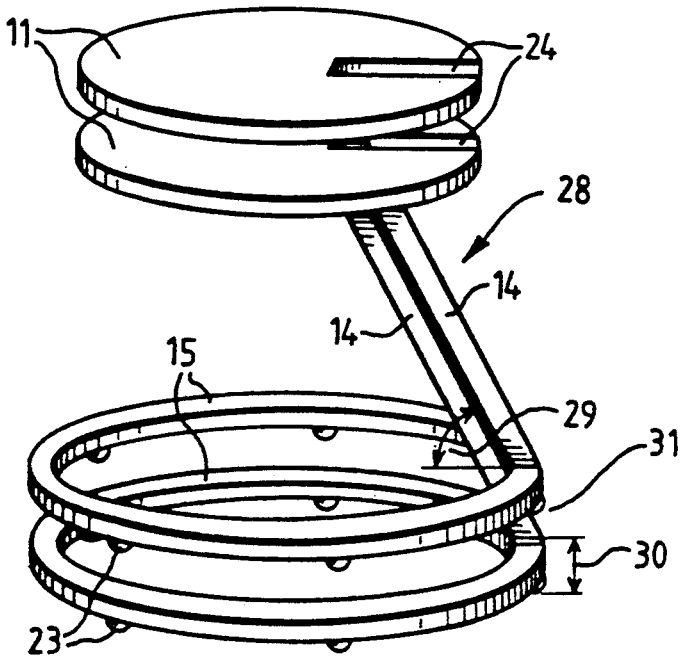
FIG. 3—the diagrammatic representation of two pivotal chairs in stacked position.

In the region of the back rest 12 the back rest frames 21 and 21*a* form a back rest cleavage 22 the width of which is somewhat greater than the diameter of the supporting column 14. The supporting column 14 proceeds from the underframe 15 in obliquely upward direction at an angle of tilt 29 so that the supporting column 14 can be guided through the back rest cleavage 22 of the swivel chair underneath during stacking, as shown in FIG. 3. The angle of tilt 29 is in this context so chosen to accommodate the height 30 of the underframe 15 and vertical stacks 31 of superposedly stacked swivel chairs can come about.

Figure 7:
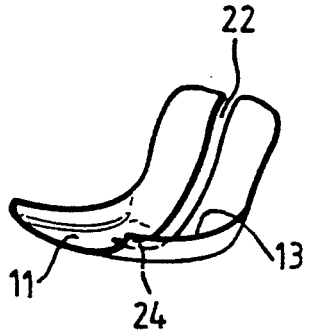
FIG. 7—the diagrammatic representation of a seat connected to a back rest comprising a seat recess converging into a back rest cleavage.

As shown in FIG. 7, the back rest cleavage 22 converges into a seat recess 24 which abuts the supporting column 14 of the swivel chair, immediately stacked thereabove.

Figure 4:
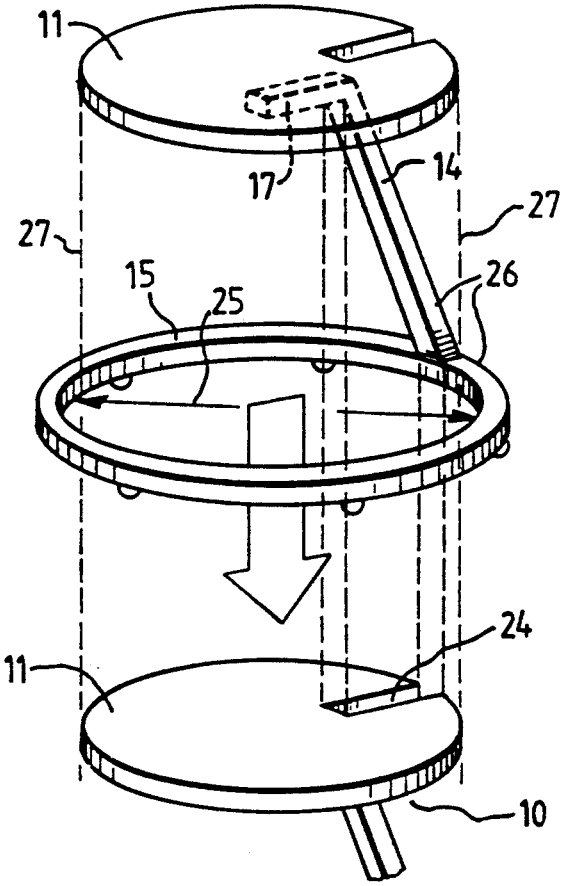
FIG. 4—the diagrammatic representation of the vertical projection of an underframe over an upper frame to be stacked thereon.

The underframe 15 is designed as a closed ring, the inner diameter 25 of which, as shown in FIG. 4, is greater than the vertical projection of the upper frame 10. The supporting column 14 is in this context linked in one piece, preferably radially on the inside, with the underframe 15.

Figure 5:
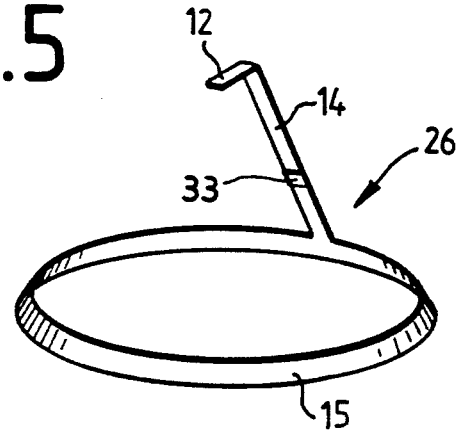
FIG. 5—the diagrammatic representation of an obliquely upwardly proceeding supporting column, provided with a bracket which is connected to an annular underframe.
Figure 6:
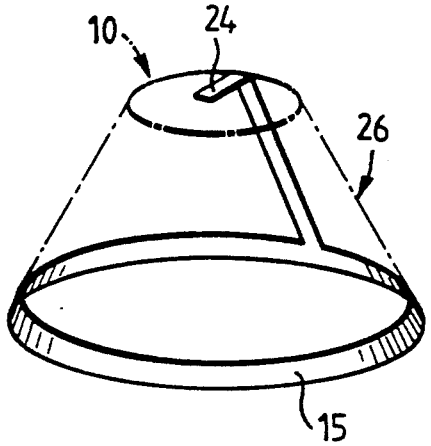
FIG. 6—the diagrammatic representation of a stackable frustum, formed by the upper frame and the underframe.

As shown in FIGS. 5 and 6, the upper frame 10 and the underframe 15 form a frustum 26 serving as a rotating body, the surface of the frustum 26 being determined by the supporting column 14.

Figure 8:
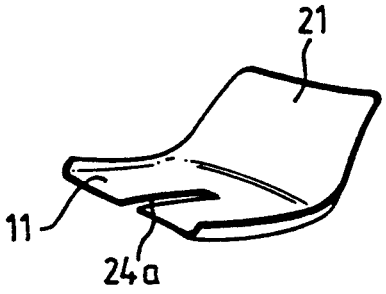
FIG. 8—the diagrammatic illustration of a seat connected to a back rest comprising a front seat recess, independent of the back rest.

In another embodiment, as shown in FIG. 8, the seat 11 on its side opposite the back rest 21 is provided with a recess **24*a*, through which the supporting column 14** may be guided during stacking.

The underframe 15 may be provided with casters 23, likewise, the column 14 may be provided with a longitudinal adjustment 33.

Figure 9:
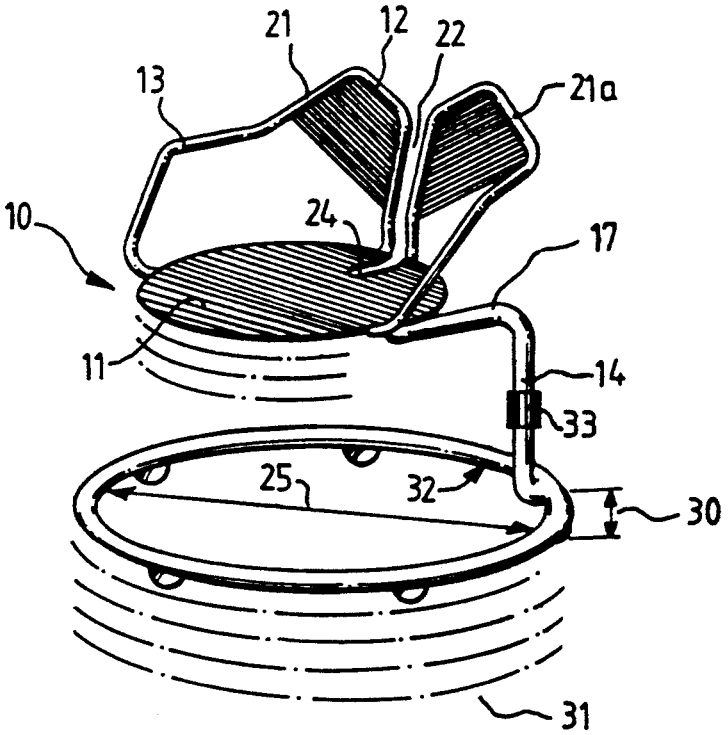
FIG. 9—the isometric representation of a stackable swivel chair comprising a supporting column proceeding essentially horizontally from the vertical projection of the upper frame and mounted outside of the latter on the underframe.

In an embodiment shown in FIG. 9, the bracket 17, connected in one piece to the supporting column 14, is guided essentially horizontally from the vertical projection 27 of the upper frame 10. In this context, the supporting column 14 extends essentially vertically from and the inner periphery 32 of underframe 15. This underframe 15 is designed as a closed ring. Instead of a closed ring, an open ring frame, not shown, may be provided. The supporting column 14 may be provided with a spring and/or a longitudinal adjustment 33 as shown in the FIG. 9 embodiment and as schematically shown in FIG. 5 for the swivel chair of FIG. 1.

As is further shown in FIG. 3, the swivel chairs may also be designed as stools 28 without back rests, the vertical projections 27 of the seats 11 being smaller than the inner diameter 25 of the underframes 15.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What we claim is:

1. A swivel chair comprising an upper frame with a seat area, an underframe and a supporting column linking the upper frame to the underframe, the upper frame having an outer periphery with a projection around the outer periphery, the column extending from the upper frame, through the projection of the upper frame, to the underframe, the chair being provided with means for stacking which comprises a recess at a periphery of the seat, the recess having a width which corresponds substantially to outer dimensions of the supporting column, the swivel chair further comprising means for pivotally mounting the seat at the upper end of the supporting column, the means for pivotally mounting comprising a bracket.

2. The swivel chair as claimed in claim 1, further comprising a back rest, the recess being provided in the back rest.

3. The swivel chair as claimed in claim 2, in which the seat and the back rest are supported by a pair of back rest frames, the recess being provided between the pair of back rest frames.

4. The swivel chair as claimed in claim 1, in which the supporting column extends from the underframe, through the projection to the upper frame at an oblique angle, the bracket being disposed between the seat and the column for accommodating a pivotal fitting which supports the seat.

5. The swivel chair as claimed in claim 1, in which the underframe generally has a ring shape, concentrically surrounding the projection of the upper frame, an inner diameter of the underframe being greater than a width of the upper frame.

6. The swivel chair as claimed in claim 5, in which the inner diameter of the underframe is substantially greater than the outer diameter of the upper frame and the supporting column forms an angle with the upper frame which is so great that when another chair is stacked thereon, the height of the underframe is balanced to form a vertical stack.

7. The swivel chair as claimed in claim 1, further comprising a longitudinal adjuster provided on the supporting column.

8. The swivel chair as claimed in claim 1, wherein the seat has a back rest and a bottom portion, the recess being located in the bottom portion of the seat.

9. A swivel chair comprising an upper frame with a seat, an underframe and a supporting column, the supporting column extending between the upper frame and the underframe, the upper frame being pivotally mounted at an upper end of the supporting column via a bracket and the supporting column being mounted to the underframe, the supporting column extending essentially horizontally from the upper frame and extending vertically to the underframe, the chair further comprising means for stacking to enable a plurality of chairs to be stacked one upon another, the means for stacking comprising a recess for receiving a supporting column of another swivel chair during stacking.

10. The swivel chair as claimed in claim 9, further comprising a back rest.

11. The swivel chair as claimed in either one of claims 9 or 10, in which the upper frame has an outer periphery with a projection around the outer periphery thereof, the supporting column extending from the upper frame, through the projection and to the underframe.

12. The swivel chair as claimed in claim 11, further comprising a longitudinal adjuster provided on the supporting column.

13. The swivel chair as claimed in claim 9, in which the supporting column is connected to the underframe at an inner periphery of the underframe.

* * * * *